US011162511B2

(12) United States Patent
Heitzig et al.

(10) Patent No.: US 11,162,511 B2
(45) Date of Patent: Nov. 2, 2021

(54) ELECTRIC MOTOR-VEHICLE COOLANT PUMP

(71) Applicant: PIERBURG PUMP TECHNOLOGY GMBH, Neuss (DE)

(72) Inventors: Lars Heitzig, Leipzig (DE); Clemens Reichel, Rossau (DE); Hemke Maeter, Dresden (DE); Falk Steiger, Markkleeberg (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 223 days.

(21) Appl. No.: 16/463,373

(22) PCT Filed: Sep. 18, 2017

(86) PCT No.: PCT/EP2017/073387
§ 371 (c)(1),
(2) Date: May 23, 2019

(87) PCT Pub. No.: WO2018/095607
PCT Pub. Date: May 31, 2018

(65) Prior Publication Data

US 2019/0353166 A1 Nov. 21, 2019

(30) Foreign Application Priority Data

Nov. 25, 2016 (DE) ..... 10 2016 122 784.6

(51) Int. Cl.
*F04D 29/58* (2006.01)
*F04D 13/06* (2006.01)

(52) U.S. Cl.
CPC ..... *F04D 29/5806* (2013.01); *F04D 13/0673* (2013.01); *F04D 13/064* (2013.01)

(58) Field of Classification Search
CPC .. F04D 3/005; F04D 13/0653; F04D 13/0673; F04D 29/528; F04D 29/708; F04D 29/5806; F01P 5/12
See application file for complete search history.

(56) References Cited

U.S. PATENT DOCUMENTS 3,135,211 A * 6/1964 Pezzillo ..... F04D 13/0613 417/357
4,644,202 A * 2/1987 Kroy ..... F04D 13/0666 277/412

(Continued)

FOREIGN PATENT DOCUMENTS

CN 1070454 A 3/1993
CN 102678574 A 9/2012

(Continued)

OTHER PUBLICATIONS

English Abstract for JP-2012145022-A (Year: 2012).*

*Primary Examiner* — Nathan C Zollinger
(74) *Attorney, Agent, or Firm* — Norman B. Thot

(57) ABSTRACT

An electric motor-vehicle coolant pump includes a housing, a pump unit with blade elements, a motor unit with a motor stator and a motor rotor which are mounted in the housing via a bearing, and inlet and outlet openings with respective center axes. The pump unit pumps a cooling fluid. The motor rotor has an impeller element and a drive element which extends in an axial direction and which has an axis of rotation. The blade elements are arranged on the impeller element. The inlet and outlet openings each allow the cooling fluid to flow through the motor unit. The outlet openings of the pump unit are arranged in the motor rotor. When viewed in an outlet direction, the respective center axes of the outlet openings include an angle α of 10° to 135° with respect to a projection of the axis of rotation into the respective outlet opening.

7 Claims, 3 Drawing Sheets

(56) References Cited

U.S. PATENT DOCUMENTS

| | | | | |
|---|---|---|---|---|
| 4,699,573 | A | 10/1987 | Petrie et al. | |
| 4,836,147 | A * | 6/1989 | Morris | F04D 13/0673 123/41.44 |
| 5,193,987 | A | 3/1993 | Iio et al. | |
| 5,997,261 | A * | 12/1999 | Kershaw | H02K 9/19 417/366 |
| 6,524,083 | B2 * | 2/2003 | Deai | F04D 13/064 417/370 |
| 10,180,142 | B2 * | 1/2019 | Teubel | F04D 29/2222 |
| 2004/0028539 | A1 | 2/2004 | Williams et al. | |
| 2004/0234395 | A1 * | 11/2004 | Hatano | F04D 13/064 417/420 |
| 2007/0014677 | A1 * | 1/2007 | Chen | F04D 13/0673 417/423.1 |
| 2012/0201700 | A1 | 8/2012 | Talaski | |
| 2016/0177962 | A1 | 6/2016 | Laing | |

FOREIGN PATENT DOCUMENTS

| | | | |
|---|---|---|---|
| DE | 199 48 972 | A1 | 4/2001 |
| DE | 603 11 177 | T2 | 5/2007 |
| DE | 10 2007 055 907 | A1 | 6/2009 |
| DE | 10 2009 009 898 | A1 | 8/2010 |
| DE | 10 2013 107 986 | A1 | 1/2015 |
| EP | 1 775 478 | A2 | 4/2007 |
| EP | 3 012 457 | A1 | 4/2016 |
| JP | 11-287200 | A | 10/1999 |
| JP | 2007-332839 | A | 12/2007 |
| JP | 2007332839 | A * | 12/2007 |
| JP | 2012-145022 | A | 8/2012 |
| JP | 2012145022 | A * | 8/2012 |

* cited by examiner

ELECTRIC MOTOR-VEHICLE COOLANT PUMP

CROSS REFERENCE TO PRIOR APPLICATIONS

This application is a U.S. National Phase application under 35 U.S.C. § 371 of International Application No. PCT/EP2017/073387, filed on Sep. 18, 2017 and which claims benefit to German Patent Application No. 10 2016 122 784.6, filed on Nov. 25, 2016. The International Application was published in German on May 31, 2018 as WO 2018/095607 A1 under PCT Article 21(2).

FIELD

The present invention relates to an electric motor-vehicle coolant pump comprising a housing having a pump unit and a motor unit, wherein the motor unit has a motor rotor, which is mounted in the housing via bearing elements, and a motor stator, wherein the motor rotor has an impeller element and a drive element which extends in the axial direction and which has an axis of rotation, wherein blade elements of the pump unit are arranged on the impeller element, wherein inlet and outlet openings having respective center axes are provided which allow a cooling fluid of the pump unit to flow through the motor unit, wherein the outlet openings of the pump unit are provided in the impeller element, and wherein the outlet openings are provided in the motor rotor.

BACKGROUND

Electric Motor-vehicle coolant pumps comprising outlet openings for fluidic connection to the suction side of the pump unit have previously been described. DE 199 48 972 A1, for example, describes a motor pump comprising a pump unit and a motor unit, wherein the motor unit comprises a motor rotor which is designed as an external rotor and which comprises an impeller element with blade elements. For cooling the motor unit, it is known to conduct to-be-pumped cooling fluid from a pressure side of the pump unit through the motor unit to a suction side of the motor unit. DE 199 48 972 A1 describes that an opening is provided in the region of the pump unit for passage of the cooling fluid into the motor unit, wherein the cooling fluid will leave the motor unit again via a hollow motor rotor shaft. It is also known that the cooling fluid can leave the motor unit via openings in the area of the hearings of the motor rotor shaft. The function and the lifespan of the motor-vehicle coolant pump in both cases may be impaired by deposition of particles contained in the cooling fluid, such as, for example, foundry sand. Particularly in case of a discharge of the cooling fluid via the bearing region, a hydroabrasive flow occurs which will cause a high radial and axial wear of the bearings, DE 10 2009 009898 A1 and US 2004/0234395 A1 therefore describe providing outlet openings in the impeller element to discharge the contaminant particles via the outlet openings, however, a contamination of the bearing region will still occur.

EP 3 012 457 A1 describes arranging the outlet openings in the region of the ends of the blade elements facing away from the center of the motor rotor, wherein the bore and thus a central axis of the outlet openings extends in the direction of the blade elements. Although such an embodiment makes it possible to prevent wear of the bearings, it is still observed that contaminant particles remain in the region of the impeller element directed toward the motor unit and consequently increase the likelihood of failure of the coolant pump.

SUMMARY

An aspect of the present invention is to avoid the above-mentioned disadvantage in a simple and inexpensive manner.

In an embodiment, the present invention provides an electric motor-vehicle coolant pump which includes a housing, a pump unit comprising blade elements, a motor unit comprising a motor stator and a motor rotor which are mounted in the housing via a bearing, inlet openings comprising respective center axes, and outlet openings comprising respective center axes. The pump unit is configured to pump a cooling fluid. The motor rotor comprises an impeller element and a drive element which extends in an axial direction and which comprises an axis of rotation. The blade elements of the pump unit are arranged on the impeller element. The inlet openings and the outlet openings are each configured to allow the cooling fluid pumped by the pump unit to flow through the motor unit. The outlet openings of the pump unit are arranged in the motor rotor. When viewed in an outlet direction, the respective center axes of the outlet openings include an angle $\alpha$ of 10° to 135° with respect to a projection of the axis of rotation into the respective outlet opening.

BRIEF DESCRIPTION OF THE DRAWINGS

The present invention is described in greater detail below on the basis of embodiments and of the drawings in which.

DETAILED DESCRIPTION

In an embodiment of the present invention, center axes of the outlet openings, when viewed in the outlet direction, include, toward the outside, an angle between $\alpha$=10° and $\alpha$=135° with a projection of the axis of rotation into the respective outlet opening. The described embodiment of the coolant pump provides that the contaminant particles will be discharged via the outlet opening nearly to their full extent without contaminant particles remaining in the region of the motor rotor and possibly damaging the pump unit.

In an embodiment of the present invention, the outlet openings can, for example, extend substantially in the tangential or radial direction relative to the projected axis of rotation of the impeller element. The angle $\alpha$ can, for example, be between 45° and 65°. A particularly safe discharge of the contaminant particles is thereby provided since the contaminant particles will be conveyed into the region of the vane elements.

The outlet openings are advantageously formed as bores arranged in a circular configuration at a uniform mutual offset in the circumferential direction. Due to the embodiment of a coolant pump as provided by the present invention, three outlet bores can, for example, be sufficient for an effective discharge of the contaminant particles.

In an embodiment of the present invention, the motor rotor can, for example, be pot-shaped, wherein the drive element is cylindrical. The contaminant particles are discharged from the interior of the motor rotors without residues despite the pot-shaped design of the motor rotor. The motor rotor is advantageously provided as an external rotor.

It can be particularly advantageous if the outlet openings are provided in the outermost region of the impeller element or, in case of a pot-shaped design of the motor rotor, in the impeller element or in the cylindrical drive element in the region of the transition from the impeller element to the drive element. It is thereby avoided that contaminant particles might remain in the pot-shaped motor rotor in a particularly effective manner.

The motor unit is advantageously provided as an electrically commutated electric motor.

The inlet opening can advantageously be provided as an annular gap between the housing and the cylindrical drive element. Particularly in case of the wet-running principle, a gap inherently exists between the cylindrical drive element and the housing which can be used in a simple manner as an inlet opening.

The present invention will be explained in greater detail below with reference to the drawings.

Figure 1:
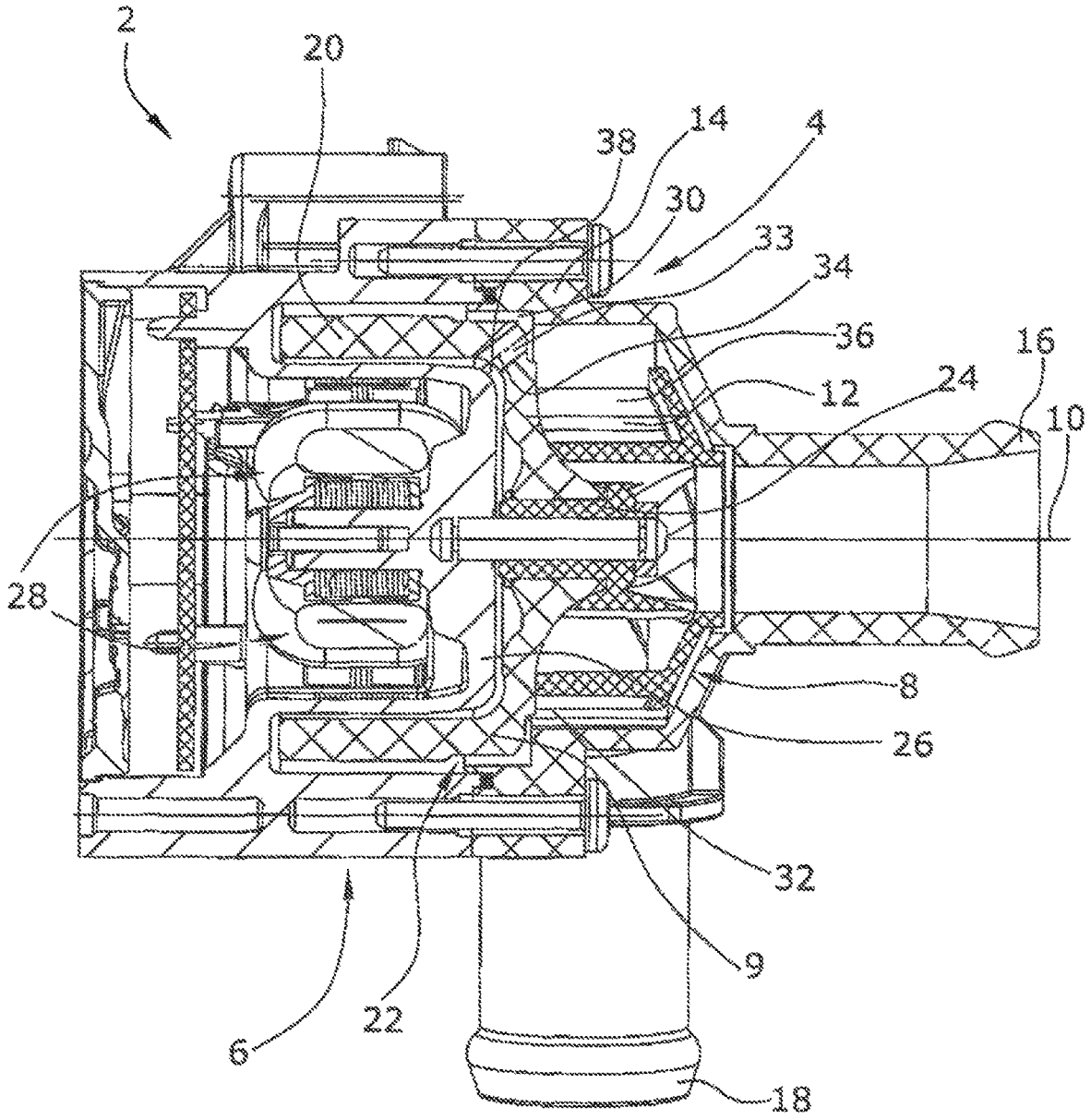
FIG. 1 shows a sectional view of a motor-vehicle coolant pump in accordance with the present invention.

FIG. 1 shows a sectional view of a motor-vehicle coolant pump 2 in accordance with the present invention. The motor-vehicle coolant pump 2 here comprises a multi-part housing 4 made of plastic in which primarily a motor unit 6 and a pump unit 8 are provided. The pump unit 8 substantially comprises an impeller element 9 having an axis of rotation 10. The impeller element 9 comprises blade elements 12 integrally molded to it in a known manner. In this exemplary embodiment, a pressure build-up is effected, by the impeller element 9, in the housing part 14 of pump unit 8 in a known manner, whereby cooling fluid can be supplied via an inlet connector 16 and can be discharged via an outlet connector 18. The impeller element 9 of pump unit 8 is integrally connected to a cylindrical drive element 20 of the motor unit 6 and in this manner forms a pot-shaped motor rotor 22. Such an arrangement is normally referred to as an external rotor. The motor rotor 22 is thereby supported in a known manner via hearing 24 in a separating can 26 of the multi-part housing 4. The motor rotor 22 together with a motor stator 28 thereby here forms an electronically commutated electric motor, wherein, internally of the cylindrical drive element 20 of motor rotor 22, embedded permanent magnets (which are not shown in greater detail in the drawings) are provided so that the motor rotor 22 will be entrained by the rotatingly-moving magnetic field which can be generated in motor stator 28, and will be caused to rotate. In the present exemplary embodiment, the inlet opening 30 for a cooling fluid provided to cool the motor unit 6 is provided in the form of an annular gap between the multi-part housing 4, here the housing part 14, and the cylindrical drive element 20. The cooling fluid will thus circulate, via this inlet opening 30, from a pressure side 32 pump unit 8 into a gap between the cylindrical drive element 20 and the separating can 26, to outlet openings 33, which in turn have central axes 34, onward to a suction side 36 of the pump unit 8. Contaminant particles possibly existing in the cooling fluid will, due to their centrifugal force, be collected in the transition 38 between the cylindrical drive element 20 and the impeller element 9 so that they cannot cause damage to the motor unit 6 and, in particular here to the hearing 24.

Figure 2:
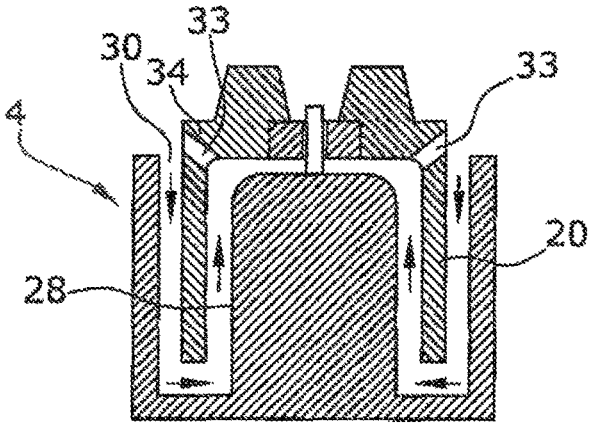
FIG. 2 shows a schematic view of the cooling fluid flow from the inlet opening between housing and drive element via a gap between drive element and separating can onward to the outlet openings.

FIG. 2 shows, in a schematic view, the cooling fluid flow from the inlet opening 30 between the multi-part housing 4 and cylindrical drive element 20 via a gap between cylindrical drive element 20 and separating can 26 onward to the outlet openings 33.

Figure 3:
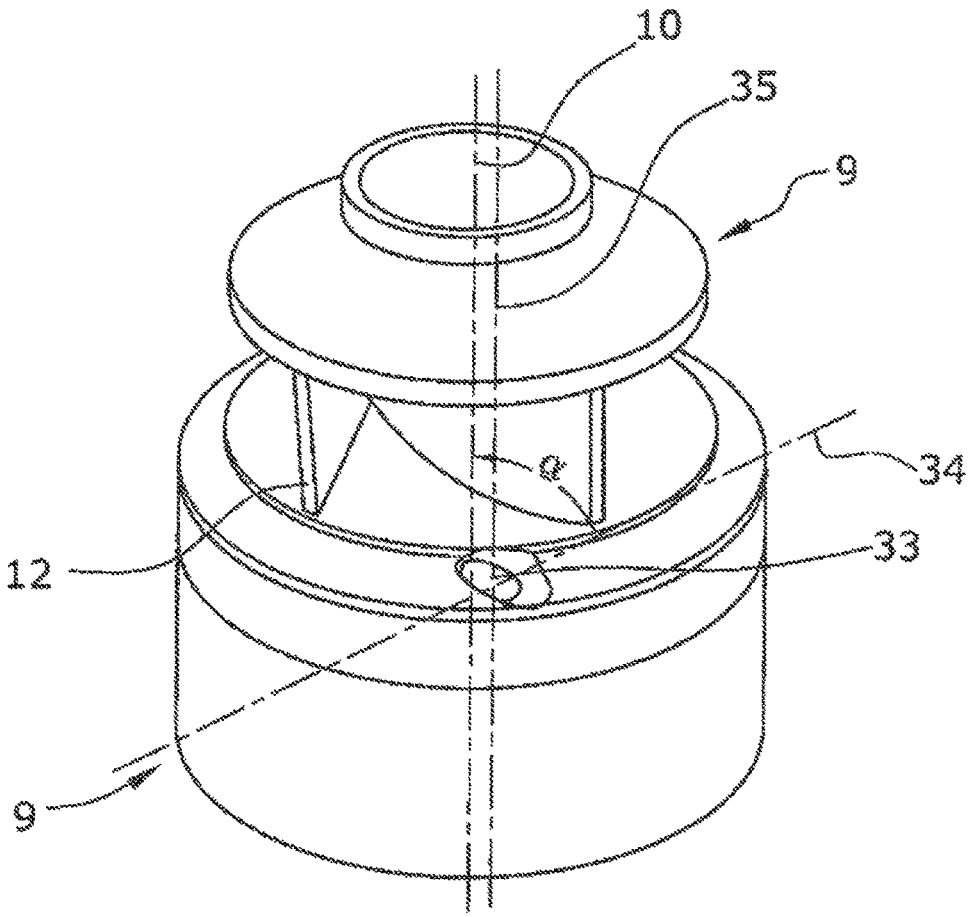
FIG. 3 shows a perspective view of the impeller element and the outlet openings which are here designed as bores and which are offset from each other by 120° in a circular configuration.

FIG. 3 again shows, in a perspective view, the impeller element 9 and the outlet openings 33 which here are designed as bores and which are offset from each other by 120° in a circular configuration. The outlet openings 33 have a tangential direction herein. Their central axis 34 together with the axis of rotation 10 projected into the respective outlet opening 33, which is shown in FIG. 3 with reference numeral 35, includes an angle $\alpha$ of 65°. The outlet opening 33, being oriented in the flow direction, herein makes use of the difference in speed between impeller element 9 and the cooling fluid. Effected thereby is a guidance of the cooling fluid, as directed by the flow, from the interior of motor rotor 22 into the housing part 14, thus effectively avoiding an accumulation of contaminant particles.

Figure 4:
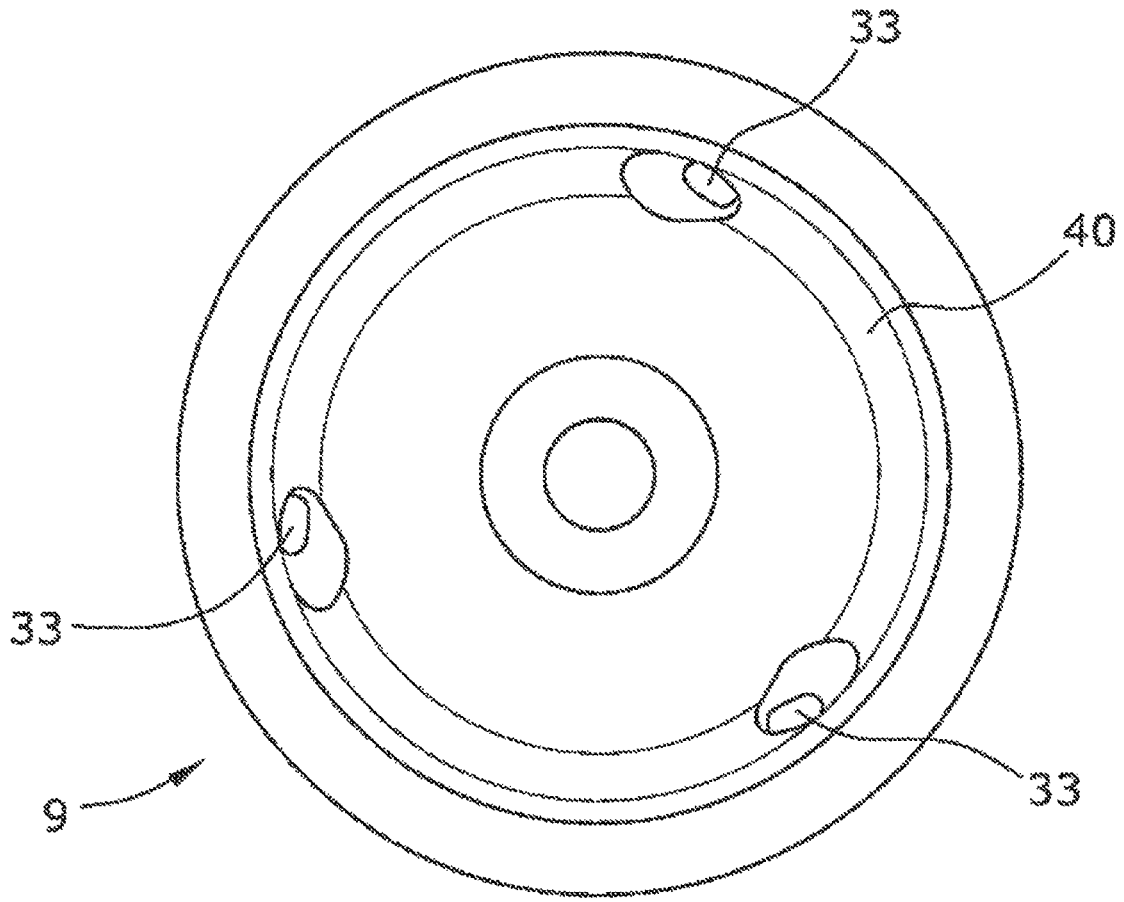
FIG. 4 shows a perspective view of the interior of the impeller element from FIG. 2.

FIG. 4 shows, in a perspective view, the interior of the impeller element 9 from FIG. 2. As a result of the arrangement of the outlet bores in accordance with the present invention, no contaminant particles will be accumulated in a bend 40 of the pot of the impeller element 9. With an inner diameter of the impeller element 9 of 35 mm, the outlet openings 33 have a diameter of 4 mm and are arranged on a circular path having a radius of 15.5 mm.

It is also possible to realize the outlet openings 33 as outlet bores extending in a radial direction.

The present invention is not limited to embodiments described herein; reference should be had to the appended claims.

What is claimed is:

1. An electric motor-vehicle coolant pump comprising:

a housing;

a pump unit comprising blade elements, the pump unit being configured to pump a cooling fluid;

a motor unit comprising a motor stator and a motor rotor which are mounted in the housing via a bearing, the motor rotor comprising an impeller element and a drive element which extends in an axial direction and which comprises an axis of rotation, the blade elements of the pump unit being arranged on the impeller element;

an inlet opening comprising a center axis; and outlet openings comprising respective center axes, wherein, the inlet opening and the outlet openings are each configured to allow the cooling fluid pumped by the pump unit to flow through the motor unit, the outlet openings of the pump unit are arranged in the motor rotor, when viewed in an outlet direction, the respective center axes of the outlet openings include an angle $\alpha$ of 10° to 135° with respect to a projection of the axis of rotation into the respective outlet opening, the outlet openings are provided in a region of a transition from the impeller element to the drive element, and the outlet openings are configured to extend substantially in a tangential direction relative to the projection of the axis of rotation.

2. The electric motor-vehicle coolant pump as recited in claim 1, wherein the angle $\alpha$ is between 45° and 65°.

3. The electric motor-vehicle coolant pump as recited in claim 1, wherein the outlet openings are formed as bores which are arranged in a circular configuration at a uniform mutual offset in a circumferential direction.

4. The electric motor-vehicle coolant pump as recited in claim 1, wherein, the motor rotor is configured to be pot-shaped, and the drive element is configured to be cylindrical.

5. The electric motor-vehicle coolant pump as recited in claim 4, wherein the motor rotor is an external rotor.

6. The electric motor-vehicle coolant pump as recited in claim 4, wherein the inlet opening is provided as an annular gap between the housing and the drive element which is configured to be cylindrical.

7. The electric motor-vehicle coolant pump as recited in claim 1, wherein the motor unit is an electrically commutated electric motor.

* * * * *